US005113030A

United States Patent [19]

Chen et al.

[11] Patent Number: 5,113,030

[45] Date of Patent: May 12, 1992

[54] HIGH VISCOSITY INDEX LUBRICANT COMPOSITIONS

[75] Inventors: Catherine S. H. Chen, Berkeley Heights; Margaret M. Wu, Belle Mead, both of N.J.

[73] Assignee: Mobil Oil Corporation, Fairfax, Va.

[21] Appl. No.: 570,745

[22] Filed: Aug. 22, 1990

Related U.S. Application Data

[63] Continuation-in-part of Ser. No. 480,709, Feb. 15, 1990, Pat. No. 4,962,249, which is a continuation-in-part of Ser. No. 210,436, Jun. 23, 1988, Pat. No. 4,990,711.

[51] Int. Cl.[5] ..... C07C 2/08; C07C 9/22

[52] U.S. Cl. ..... 585/10; 585/12; 585/18; 585/17

[58] Field of Search ..... 585/10, 17, 18, 12, 585/520, 533, 314, 315, 326, 329, 502, 504

[56] References Cited

U.S. PATENT DOCUMENTS

| | | | |
|---|---|---|---|
| 4,180,524 | 12/1979 | Reusser et al. | 585/644 |
| 4,431,855 | 2/1984 | Reusser et al. | 585/360 |
| 4,499,328 | 2/1985 | Kukes et al. | 585/646 |
| 4,504,694 | 3/1985 | Kukes et al. | 585/643 |
| 4,517,401 | 5/1985 | Kukes et al. | 585/645 |
| 4,547,617 | 10/1985 | Welch et al. | 585/646 |
| 4,665,245 | 5/1987 | Quann | 585/316 |
| 4,827,064 | 5/1989 | Wu | 585/10 |
| 4,827,073 | 5/1989 | Wu | 585/18 |
| 4,962,249 | 10/1990 | Chen et al. | 585/17 |
| 5,012,020 | 4/1991 | Jackson et al. | 585/18 |

*Primary Examiner*—Margaret Medley
*Attorney, Agent, or Firm*—Alexander J. McKillop; Charles J. Speciale; L. G. Wise

[57] ABSTRACT

Novel synthetic lubricants having high viscosity index are made from lower olefins. These materials have a viscosity above about 2 cS at 100° C. and viscosity index above about 130 and are characterized by internal methyl groups attached to side chain tertiary carbon atoms.

Hydrocarbon lubricant can be based on propene feedstock with the resulting oligomer containing less than 2.5 methyl groups per 12 carbon atoms.

2 Claims, 2 Drawing Sheets

HIGH VISCOSITY INDEX LUBRICANT COMPOSITIONS

REFERENCE TO COPENDING APPLICATIONS

This application is a continuation in part of U.S. patent application Ser. No. 07/480,709, filed Feb. 15, 1990 now U.S. Pat. No. 4,962,249; which is a continuation in part of application Ser. No. 07/210,436, filed Jun. 23, 1988 now U.S. Pat. No. 4,990,711, incorporated herein by reference.

BACKGROUND OF THE INVENTION

This invention relates to hydrocarbon lubricants having high viscosity index (VI) from near linear alpha olefins derived from inexpensive lower alkenes by employing the intermediate production of near linear internal olefin oligomers. More particularly, the invention relates to the discovery that a complex mixture of higher alpha olefins produced by co-metathesis of slightly branched internal higher olefins with ethylene can be oligomerized to provide novel lubricants that possess superior properties relating to pour point and viscosity index.

In the processes known in the art for catalytic conversion of olefins to heavier hydrocarbons by catalytic oligomerization using a medium pore shape selective acid crystalline zeolite, such as ZSM-5 type catalyst, process conditions can be varied to favor the formation of hydrocarbons of varying molecular weight. At moderate temperature and relatively high pressure, the conversion conditions favor $C_{10}+$ aliphatic product. Lower olefinic feedstocks containing $C_2$–$C_8$ alkenes may be converted; however, the distillate mode conditions do not convert a major fraction of ethylene. A typical reactive feedstock consists essentially of $C_3$–$C_6$ mono-olefins, with varying amounts of nonreactive paraffins and the like being acceptable components.

U.S. Pat. Nos. 4,520,221, 4,568,786 and 4,658,079, to C. S. H. Chen et al., incorporated herein by reference in their entirety, disclose further advances in zeolite catalyzed olefin oligomerization. These patents disclose processes for the oligomerization of light, or lower, olefins using zeolite catalyst such as ZSM-5. The oligomers so produced are near linear in structure and contain internal olefin unsaturation.

These unique olefinic oligomers are produced by surface deactivation of the ZSM-5 type catalyst by pretreatment with a surface-neutralizing base. The processes of Chen et al. provide a particularly useful means to prepare higher olefinic hydrocarbons from inexpensive lower olefins, particularly propylene.

Efforts to improve upon the performance of natural mineral oil based lubricants by the synthesis of oligomeric hydrocarbon fluids have led to the relatively recent market introduction of a number of superior polyalpha-olefin synthetic lubricants, primarily based on the oligomerization of alpha-olefins or 1-alkenes. Well known structure/property relationships have pointed the way to 1-alkenes as a fruitful field of investigation for the synthesis of oligomers with the structure thought to be needed to confer improved lubricant properties thereon. Building on that resource, oligomers of 1-alkenes from $C_6$ to $C_{20}$ have been prepared with commercially useful synthetic lubricants from 1-decene oligomerization yielding a distinctly superior lubricant product via either cationic or coordination catalyzed polymerization. Of notable importance is the inventions described in U.S. Pat. Nos. 4,827,064 and 4,827,073, to M. W., incorporated herein by reference, where superior hydrocarbon lubricants are prepared having low methyl to methylene branch ratio by oligomerization of alpha olefins using reduced valence state Group VIB metal oxide catalyst on porous support.

As a feedstock to prepare lubricants by cationic, coordination or Ziegler catalysis the olefinic oligomers provided by the aforementioned Chen process are ill-suited for two reasons. First, they comprise predominately internal olefins where alpha olefins are required. Secondly, the olefinic oligomers are slightly branched. The prior art for the preparation of synthetic lubricants teaches the oligomerization of linear alpha olefins to produce lube oligomers where little or no branching is preferred. However, it is known that olefin metathesis carried out between lower alpha olefins such as ethylene and higher internal olefins produces higher alpha olefins. Olefin metathesis is described in *Olefin Metathesis* by K. J. Ivin, published by Academic Press, wherein Chapter 5 describes olefin metathesis with ethene. The olefin metathesis reaction applied to the olefinic oligomers of Chen et al. could provide a route to alpha olefins suitable for the production of synthetic lubricants.

It is an object of the present invention to provide novel high VI synthetic lubricants from slightly branched higher internal olefins. Another object is to provide unique lubricants by oligomerization of slightly and linear alpha olefins using reduced valence state Group VIB metal oxide catalyst on porous support.

SUMMARY OF THE INVENTION

A novel synthetic hydrocarbon lubricant has been discovered having a viscosity above about 2 cS at 100° C. and VI above about 130, a branch index above 0.20 and containing less than 2.5 methyl groups per 12 carbon atoms, wherein about 25 to 50% of the methyl groups are internal and attached to tertiary carbons. Advantageously, this lubricant can be based on inexpensive propene feedstock.

These new hydrocarbon lubricant fluid compositions are made by contacting a mixture comprising slightly branched and linear higher alpha olefins under oligomerization conditions with a reduced valence state Group VIB metal catalyst on porous support; wherein said higher alpha olefins comprise the olefin metathesis reaction product of slightly branched higher olefinic hydrocarbons with lower olefinic hydrocarbons in contact with metathesis catalyst, and said higher olefinic hydrocarbons comprise the oligomerization product of lower alkene oligomerized in contact with surface deactivated, acidic, medium pore, shape selective metallosilicate catalyst under oligomerization conditions; and separating the higher alpha olefins oligomerization reaction product to provide said lubricant having a branch index above 0.20, a viscosity index greater than 130 and a pour point less than −15° C.

DESCRIPTION OF THE INVENTION

The inventive compositions are made by the steps of: lower olefin oligomerization to near linear higher olefins; metathesis of these olefins to alpha olefins; and oligomerization of the alpha olefins to hydrocarbon lubricant fluids.

Near linear higher olefinic hydrocarbons produced by the oligomerization of lower olefins using surface deactivated zeolite catalyst can be converted to a mixture comprising slightly branched and linear higher alpha olefins. These alpha olefins are oligomerized to lubricant grade hydrocarbons in contact with cationic, Ziegler or coordination catalyst. Oligomerization of the aforementioned alpha olefins using reduced valence state Group VIB metal oxide catalyst on porous support provides a hydrocarbon lubricant with a viscosity index of greater than 130 at 100° C.

Figure 1:
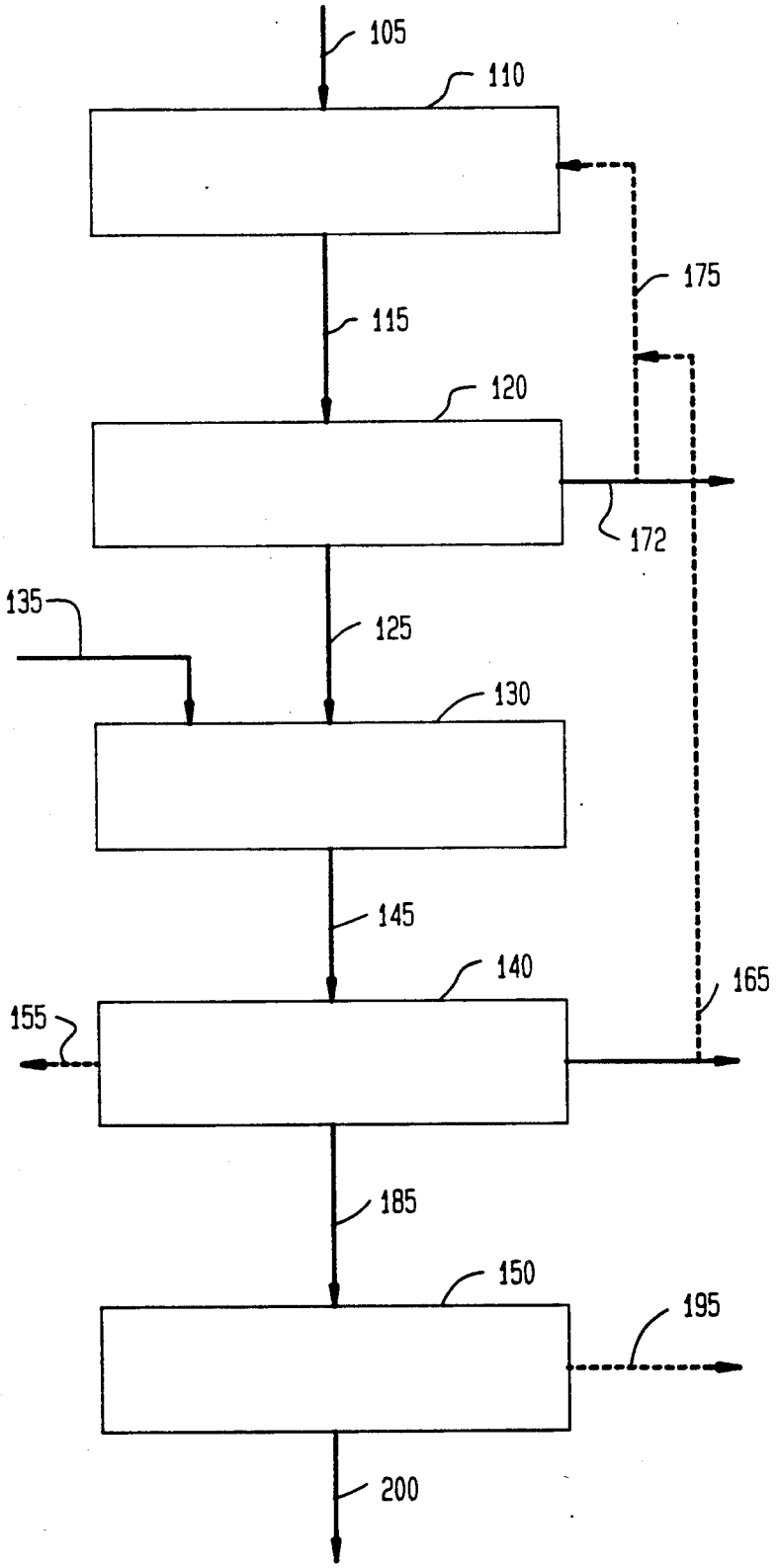
FIG. 1 is a schematic flow diagram of a preferred embodiment of the synthesis process.

Referring to FIG. 1, a block flow diagram is presented illustrating a particular embodiment of the present invention. In the Figure, a lower alkene 105, preferably propylene, is passed to alkene conversion or oligomerization zone 110 containing acidic zeolite catalyst particles. The zeolite is preferably ZSM-5 or ZSM-23 which has been pretreated with a bulky or sterically hindered amine to deactivate the surface of the catalyst. Oligomerization is carried out under the conditions previously described herein and further described in the aforementioned patents to C. S. H. Chen and the patent to Page et al. The reaction effluent 115 is passed to a separator 120, i.e., a distillation tower, wherein the slightly branched olefinic higher hydrocarbons are separated to provide a $C_9-$ fraction 172 and a $C_8+$ fraction 125. The $C_9-$ fraction may be collected or passed as a recycle stream 175 to 110 for further oligomerization. The $C_9+$ fraction is passed to the olefin metathesis reactor 130 in conjunction with an ethylene stream 135 comprising a stoichiometric excess of ethylene to suppress self-metathesis of higher olefinic hydrocarbons. In zone 130 the metathesis reaction is carried out, preferably at a temperature of about ambient (23° C.) and in contact with rhenium oxide (ReOx) catalyst and tetramethyl tin as co-catalyst. The mixture of olefins from the metathesis reaction 145 is passed to another separator 140 where it is fractionated to provide an unreacted ethylene stream 155 which can be recycled to zone 130; a stream 165 comprising olefinic hydrocarbons from $C_3$ to $C_9$ which can also be recycled 165 to the oligomerization zone 110; and a product stream 185 comprising a mixture of $C_9+$ slightly branched and linear alpha olefins as well as some vinylidenic olefins. Obviously, in the present invention the cut taken in the separator 140 can be optionally adjusted to provide a stream 185 comprising $C_{10}+$ or higher hydrocarbons.

The alpha olefin mixture, i.e., stream 185, is passed to an alpha olefins oligomerization zone 150 containing CO reduced chromium oxide catalyst on silica wherein the oligomerization is carried out under the condition described in the referenced patents to M. Wu. The product stream separated 200 comprises a slightly branched olefinic hydrocarbon lubricant with a high viscosity index and low pour point. Optionally, components of the reaction product below $C_{20}$ or $C_{30}$ may be separated and recycled to zone 110 for further oligomerization.

The olefinic product 200 is typically hydrogenated by conventional means to provide a nearly saturated superior lubricant product.

Near-Linear Olefin

The olefin oligomers used as starting material in the present invention are prepared from $C_3$-$C_5$ olefins according to the methods presented by Chen et al. in the aforementioned patents cited and in N. Page and L. Young U.S. Pat. No. 4,855,527 and incorporated herein by reference. Shape-selective oligomerization, as it applies to conversion of $C_3$-$C_5$ olefins over ZSM-5, is known to produce higher olefins up to $C_{30}$ and higher. Reaction conditions favoring higher molecular weight products are low temperature (200°-260° C.), elevated pressure (about 2000 kPa or greater) and long contact times (less than 1 WHSV). The reaction under these conditions proceeds through the acid catalyzed steps of oligomerization, isomerization-cracking to a mixture of intermediate carbon number olefins, and interpolymerization to give a continuous boiling product containing all carbon numbers. The channel system of ZSM-5 type catalysts impose shape selective constraints on the configuration of large molecules, accounting for the differences with other catalysts.

The shape-selective oligomerization/polymerization catalysts preferred for use herein to prepare the olefin oligomers used as starting material in the invention include the crystalline aluminosilicate zeolites having a silica to alumina molar ratio of at least 12, a constraint index of about 1 to 12 and acid cracking activity of about 50-300. Representative of the ZSM-5 type zeolites are ZSM-5, ZSM-11, ZSM-12, ZSM-23, ZSM-35 and ZSM-48. ZSM-5 is disclosed and claimed in U.S. Pat. No. 3,702,886, incorporated herein by reference. A suitable shape selective medium pore catalyst for fixed bed is a small crystal H-ZSM-5 zeolite (silica:alumina ratio=70:1) with alumina binder in the form of cylindrical extrudates of about 1-5 mm. Unless otherwise stated in this description, the catalyst shall consist essentially of ZSM-5, which has a crystallite size of about 0.02 to 0.05 micron, or ZSM-23. Other pentasil catalysts which may be used in one or more reactor stages include a variety of medium pore siliceous material disclosed in U.S. Pat. Nos. 4,414,423 and 4,417,088, incorporated herein by reference.

The acid catalysts are surface-deactivated by pretreatment with a surface-neutralizing base, as disclosed by Chen et al. and Page et al. in the aforementioned patents incorporated by reference. Surface deactivation is carried out using bulky or sterically hindered bases, typically those comprising trialkyl substituted pyridines. These hindered bases have very limited access to the internal pore structure of the catalyst, leaving the pores active sites for near linear oligomerization. However, active surface sites which are not constrained, as pores are, to low branching oligomerization are neutralized.

Considering propylene oligomerization for purposes of illustration, the olefinic oligomerization-polymerization products include $C_{10}+$ substantially linear aliphatic hydrocarbons. The ZSM-5 catalytic path for propylene feed provides a long chain with approximately one to two lower alkyl (e.g., methyl) substituent per 12 carbon atoms in the straight chain.

When propylene or butene are oligomerized according to processes described herein, a unique mixture of liquid hydrocarbon products are formed. More particularly, this mixture of hydrocarbons may comprise at least 95% by weight of mono-olefin oligomers of the empirical formula:

$$(C_nH_{2n})_m$$

where n is 3 or 4 and m is an integer from 1 to approximately 10, the mono-olefin oligomers comprising at least 20 percent by weight of olefins having at least 12 carbon atoms. Those olefins having at least 12 carbon atoms have an average of from 0.80 to 2.50 methyl side groups per carbon chain. The olefin side groups are predominantly methyl.

It will be understood that methyl side groups are methyl groups which occupy positions other than the terminal positions of the first and last (i.e., alpha and omega) carbon atoms of the longest carbon chain. This longest carbon chain is also referred to herein as the carbon backbone chain of the olefin. The average number of methyl side groups for the $C_{12}$ olefins may comprise any range within the range of 0.80 to 2.50.

These oligomers may be separated into fractions by conventional distillation separation. When propylene is oligomerized, olefin fractions containing the following number of carbon atoms can be obtained: 6, 9, 12, 15, 18 and 21. When butene is oligomerized, olefin fractions containing the following numbers of carbon atoms may be obtained: 8, 12, 16, 20, 24 and 28. It is also possible to oligomerize a mixture of propylene and butene and to obtain a mixture of oligomers having at least 6 carbon atoms.

in U.S. Pat. No. 4,855,527, Page and Young describe these new olefins as multi-component mixtures of propylene oligomers having relatively few branching methyl groups on the carbon backbone. As an example of branching, the dodecene fraction prepared from propylene and HZSM-23 [ZSM23-dodecenes] typically has 1.3 methyl branches. This can be reduced to 1.0 or less by varying reaction conditions.

The olefin oligomers produced from surface deactivated zeolite catalysis contain a mixture of types of olefin unsaturation with internal disubstituted and trisubstituted olefins dominating. Table 1 shows a comparison of two ZSM-23 collidine derived $C_{11}$+ propylene oligomers prepared according to the method of Page and Young. The oligomers have been determined by gas chromatography to contain 1.2 and 1.8 methyl branches per 12 carbon atoms. Analysis by proton NMR shows the following distribution of olefin types:

TABLE 1

| $C_{11}$+ Olefins - Mole Ratio of Olefin Types | | | | |
|---|---|---|---|---|
| Oligomer | Alpha | Disubst. | Trisubst. | Vinylidene |
| 1.2 $CH_3$/12C | 0.0 | 44.9 | 49.0 | 6.1 |
| 1.8 $CH_3$/12C | 5.7 | 39.1 | 54.2 | 1.0 |

Olefin Metathesis

The metathesis of the slightly branched olefinic hydrocarbons resulting from the olefin oligomerization operation is carried out to provide alpha olefins in a primary reaction which can be thought of as comprising the breaking of two unsaturated bonds between first and second carbon atoms and between third and forth carbon atoms, respectively, and the equilibrium formation of two new alpha olefinic bonds in different molecules as illustrated in the following formulas employing ethylene as the feed alpha-olefin:

1) from trisubstituted olefins

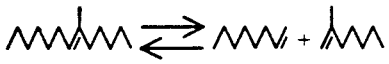

-continued

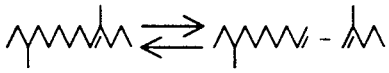

2) from disubstituted olefins

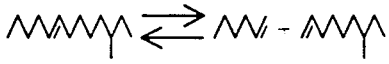

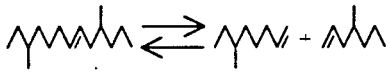

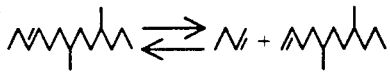

The equilibrium is displaced to the right in the presence of excess ethylene.

The reaction produces linear alpha olefins, branched alpha olefins and vinylidene olefins. The structure and molecular weight of the product olefins depend on the structure of the starting oligomers. For olefins of carbon number $C_n$ which have undergone the metathesis with ethylene, the product olefins have an average molecular weight, on a molar basis, of $C_{n/2}+1$. The average molecular weight may be raised as appropriate for subsequent oligomerization by removal of $<C_9$ olefins by distillation.

As described in Table 1, trisubstituted olefins account for a major share of olefins in the slightly branched olefin oligomers. Where these trisubstituted olefins are isoolefinic, i.e., having the structure (R(CH3)C=CCHR, they account for a major share, as well, of the methyl branching in the olefin oligomer. Their reaction in metathesis with ethylene produces an alpha olefin and a vinylidenic olefin, as already shown. Further, it is known that vinylidene olefins are unreactive in reduced chromium oxide catalyzed and Ziegler catalyst catalyzed oligomerization. Accordingly, the olefin metathesis reaction of slightly branched olefin described here produces a mixture of olefins where only a portion, alpha olefins, are oligomerizable with Ziegler or chromium catalyst to higher lubricant grade hydrocarbon oligomers. A large portion of the methyl branching in the starting olefins is effectively removed from inclusion in higher oligomers produced by coordination catalyst by conversion to vinylidene structures through metathesis with ethylene.

In general any of the $C_{2-8}$ alpha olefins can be reacted with the oligomerization product effluent in the metathesis operation herein. Some specific examples of such alpha-olefins are ethylene, propylene, 1-butene, 1-pentene, 1-hexene, 1-octene, and the like with ethylene being preferred.

Any of the catalysts heretofore employed in olefin metathesis are suitably utilized in the metathesis conversion herein. Many of these catalyst have been reported in the prior art. Preferably, the catalyst is one of molybdenum, tungsten, or rhenium oxide deposited on a support of silica, alumina, silica-alumina or aluminum phosphate. An additional metal oxide, e.g., a rare earth metal oxide, can also be present as is known. Prior to its use, the catalyst is activated by calcination carried out in a conventional manner. A particularly suitable catalyst is molybdenum oxide supported on a mixture of amorphous precipitated silica and colloidal silica. A preferred catalyst is rhenium oxide on alumina. Co-catalysts, including tetraalkyl tin, are useful. A particularly preferred catalyst is rhenium oxide on gamma-alumina plus tetramethyl tin co-catalyst.

Suitable conditions for the metathesis reaction include a pressure of from about 50-35000 KPa, a temperature of from about 0° C. to about 500° C., and space velocities of from about 1 to about 300 WHSV based on the nature of the metathesis catalyst. Although the activity of the catalyst is suitable within the broad ranges mentioned above, increased activity is generally found when the pressure is from about 700 to about 3500 KPa, the temperature range is from about 20°-100° C., and the WHSV is from about 0.5 to about 1000. The process can be carried out either in the presence or absence of a diluent. Diluents comprising paraffinic and cycloparaffinic hydrocarbons can be employed. Suitable diluents are, for example, propane, cyclohexanes, methylcyclohexane, normal pentane, normal hexane, Isooctane, dodecane, and the like, or mixtures thereof, including primarily those paraffins and cycloparaffins having up to 12 carbon atoms per molecule. The diluent should be nonreactive under the conditions of the reaction. The reaction can also be carried out in a single unit or a battery of units employing the same or a different catalyst.

The amount of alpha-olefin employed in the metathesis conversion can vary widely and will depend in part on the degree of unsaturation in the higher olefin feed which can be readily quantified employing known techniques, e.g., bromine number. Generally, the alpha-olefin, particularly, will be present in stoichiometric excess of the amount theoretically required but can be substantially less than this. The amount of alpha olefin should be an amount sufficient to suppress the self-metathesis reaction which can occur between two molecules of the near linear olefin feedstock. When ethylene is used as the alpha olefin that amount is typically about a two to five molar excess. If desired, excess alpha-olefin can be separated from the metathesis product effluent and recycled to this stage.

It has been discovered that in the metathesis reaction between the near linear higher olefins and ethylene trisubstituted olefins are less active than disubstituted olefins. The conversion of disubstituted olefins proceeds effectively at ambient temperature (23° C.) in the presence of a cocatalyst $Sn(CH_3)_4$, or at 75°-100° C. in the absence of a cocatalyst $Sn(CH_3)_4$. Trisubstituted olefins, i.e., those containing isoolefin groups, are not converted in the absence of a cocatalyst $Sn(CH_3)_4$ even at elevated temperature (75° C.). Optionally, this relationship can be readily utilized to reduce the extent of trisubstituted olefin metathesis to produce vinylidene olefins in favor of predominantly disubstituted olefin metathesis with ethylene to produce alpha olefins.

The following non-limiting Examples are provided to illustrate the olefin metathesis reaction employed in the present invention.

EXAMPLE I

Near linear olefins were prepared from propylene or isobutene or refinery mixtures of propylene, butenes, propane and butanes, using 2,6-di-tert-butylpyridine modified HZSM-5B as the shape selective catalyst according to the procedures described in U.S. Pat. No. 4,520,221.

A 340° C.+ fraction is separated from the product mixture produced from propylene at 200° C. using 2,6-di-tert-butylpyridine modified HZSM-5 B as the catalyst. This fraction contains on the average 26 carbons. NMR results lead to calculated ranges of 1.12 to 1.43 methyl branches per average molecule, 0.1 to 0.13 ethyl groups, and 0.18 to 0.23 propyl groups.

EXAMPLE II

Near linear olefins with 1 to 2 methyl branches per 10 carbon atoms were prepared from propylene or refinery mixtures of propylene, butenes, propane and butane, using 2,4,6-collidine modified HSM-23 as the shape selective catalyst according to procedures described by Page and Young in the reference previously cited.

EXAMPLE III-IV

An oligomer mixture prepared from propylene according to Example I is removed of the $C_9^-$ fraction. The $C_9^-$ fraction is recycled with propylene to make high oligomers according to Example I or II. Two hundred grams of the $C_8^+$ oligomer feed are deoxygenated and charged into a 450 cc Parr reactor under nitrogen. A $Re_2O_7/Al_2O_3$ catalyst with 22% $Re_2O_7$ loading is prepared and activated by heating at 550° C. in a stream of air for 3 hours, followed by heating in nitrogen for one hour. A calculated amount of $ReO_x$ catalyst and $Sn(CH_3)_4$ cocatalyst is added into the reactor under nitrogen. The ratio of catalyst to cocatalyst is Re:Sn = 1. The reactor is closed, flushed with ethylene and charged with 7000 KPa of ethylene. Different molar ratios of the olefin feed and activated $Re_2O_7$ with $Sn(CH_3)_4$ are used in each Example. The number of moles of the olefin feed is determined by bromine titration. The reaction takes place at room temperature, and after five hours the maximum extent of co-metathesis is reached. Due to the presence of excess ethylene, self metathesis is nearly completely suppressed.

| Expl. | Olefin/$ReO_x$—$Sn(CH_3)_4$ Mole Ratio | Temp., °C. | Conversion |
|---|---|---|---|
| III | 50 | Rm. temp. | 65% |
| IV | 10 | Rm. temp. | 85% |

EXAMPLES V-VI

A total oligomer mixture prepared according to Example I is co-metathesized with ethylene as described in Example III-IV, except the catalyst used here is $WCl_6$ which is purified by sublimation before it is added to the reactor. The reaction takes place at 70° C. and a maximum conversion is reached in five hours. Again, self metathesis of the olefins is nearly completely suppressed due to the presence of excess ethylene.

| Example | Olefin/catalyst Mole Ratio | Temp. °C. | Conversion |
|---|---|---|---|
| V | 50 | 70 | 57% |
| VI | 10 | 70 | 80% |

EXAMPLE VII 25 grams of $Re_2O_7/Al_2O_3$ containing 22% $Re_2O_7$ are packed into a fixed bed reactor. The catalyst is activated in the reactor, and the reactor is flushed with ethylene and pressurized with ethylene at 7000 KPa. An oligomer mixture prepared from propylene according to Example II is distilled of the $C_6$= fraction and charged into an ISCO pump. The oligomers are pumped into the reactor passing through an online bomb containing deoxygenating agent. The reactor is maintained at 100° C. and 7000 KPa ethylene pressure by cofeeding ethylene, and the oligomers are pumped through the reactor (downflow) at 0.5 WHSV. The product contains 70-80% co-metathesized products as shown by GC.

The composition of the metathesized product varies according to the composition of the higher olefin starting material and reaction conditions, as illustrated in the following Examples VIII and XI.

EXAMPLE VIII

Olefin metathesis was carried out under the following conditions and the product was analyzed by gas chromatography to provide the results shown in Table 2. gm Catalyst: $ReO_x$/gamma-$Al_2O_3$, 3.0
Oligomers: $C_{11}$+ Olefins, (1.3 CH3/12C), 75 gms
Ethylene Pressure: 3500 Kpa at room temperature

TABLE 2

| Olefin Component | Percent time (hrs)/Temp °C. | | | | | |
|---|---|---|---|---|---|---|
| | 0 | 46.1/23 | 94.3/24 | 142.3/24 | 244.0/26 | 264.0/22 |
| = or <C6 | 0 | 4.1 | 3.6 | 5.6 | 6.4 | 8.4 |
| $C_7$-$C_8$ | 0 | 7.0 | 7.7 | 10.1 | 10.9 | 10.8 |
| $C_9$ | 1.0 | 5.0 | 5.5 | 6.9 | 7.0 | 6.9 |
| $C_{10}$-$C_{11}$ | 0.6 | 8.3 | 9.2 | 11.0 | 10.8 | 10.8 |
| $C_{12}$ | 40.3 | 31.5 | 29.4 | 29.8 | 26.9 | 26.8 |
| $C_{13}$-$C_{14}$ | 2.2 | 5.3 | 6.7 | 6.4 | 6.4 | 6.4 |
| $C_{15}$ | 37.8 | 25.9 | 23.7 | 19.5 | 19.8 | 19.3 |
| $C_{16}$-$C_{17}$ | 0.9 | 1.5 | 1.7 | 1.6 | 1.8 | 1.5 |
| $C_{18}$ | 13.6 | 8.2 | 9.4 | 6.8 | 7.7 | 7.0 |
| >$C_{18}$ | 3.6 | 3.2 | 3.1 | 2.3 | 2.3 | 2.1 |

EXAMPLE IX

Olefin metathesis was carried out under the following conditions and the product was analyzed by gas chromatography to provide the results shown in Table 3.
Catalyst: $ReO_x$/gamma-$Al_2O_3$, 3.0 gm
Oligomers: $C_{11}$+ Olefins, (1.3 CH3/12C), 75 gms
Ethylene Pressure: 5600 Kpa at room temperature

EXAMPLE X

Olefin metathesis was carried out under the following conditions and the product was analyzed by gas chromatography to provide the results shown in Table 4.
Catalyst: $ReO_x$/gamma-$Al_2O_3$, 4.0 gm
Oligomers: $C_{11}$+ Olefins, (1.4 CH3/12C), 75 gms
Cocatalyst: 1.4 gms $Sn(CH_3)_4$ in 50 ml hexane: 10 ml
Ethylene Pressure: 5600 Kpa at room temperature

TABLE 3

| Olefin Component | Percent time (hrs)/Temp °C. | | | | | | |
|---|---|---|---|---|---|---|---|
| | 0 | 0.25/41-103 | 16.0/102 | 23.0/102 | 39.2/102 | 46.7/102 | 63.3/102 |
| = or <C6 | 0 | 0.5 | 3.5 | 4.7 | 5.1 | 5.2 | 6.0 |
| $C_7$-$C_8$ | 0 | 0.5 | 7.0 | 10.4 | 11.6 | 10.9 | 11.6 |
| $C_9$ | 1.0 | 1.2 | 5.4 | 7.5 | 8.2 | 7.7 | 8.4 |
| $C_{10}$-$C_{11}$ | 0.6 | 1.5 | 8.1 | 11.9 | 12.6 | 12.2 | 12.9 |
| $C_{12}$ | 40.3 | 39.7 | 30.3 | 25.8 | 24.1 | 23.6 | 24.1 |
| $C_{13}$-$C_{14}$ | 2.2 | 2.1 | 5.7 | 7.9 | 7.8 | 8.4 | 8.2 |
| $C_{15}$ | 37.8 | 37.1 | 25.3 | 19.0 | 17.3 | 17.8 | 17.1 |
| $C_{16}$-$C_{17}$ | 0.9 | 0.9 | 2.3 | 2.8 | 3.2 | 3.5 | 2.9 |
| $C_{18}$ | 13.6 | 13.3 | 9.5 | 6.6 | 6.9 | 7.2 | 5.9 |
| >$C_{18}$ | 3.6 | 3.2 | 2.9 | 3.4 | 3.2 | 3.5 | 2.9 |

TABLE 4

| Olefin Component | Percent time (hrs)/Temp °C. | | | | | | |
|---|---|---|---|---|---|---|---|
| | 0 | 2.08/26 | 6.02/25 | 16.9/24 | 24.0/21 | 33.0/24 | 41.7/25 |
| = or <C6 | 0 | 2.7 | 7.1 | 7.7 | 9.4 | 9.6 | 9.0 |
| $C_7$-$C_8$ | 0 | 3.7 | 13.1 | 17.4 | 19.8 | 19.7 | 19.6 |
| $C_9$ | 0 | 2.9 | 7.5 | 9.6 | 10.6 | 10.6 | 10.5 |
| $C_{10}$-$C_{11}$ | 1.7 | 4.0 | 12.3 | 16.1 | 17.0 | 16.9 | 16.5 |
| $C_{12}$ | 43.9 | 40.2 | 27.5 | 22.3 | 20.0 | 20.2 | 19.9 |
| $C_{13}$-$C_{14}$ | 1.1 | 2.5 | 5.8 | 7.6 | 7.5 | 7.8 | 7.7 |
| $C_{15}$ | 35.2 | 29.3 | 16.9 | 12.3 | 10.3 | 9.0 | 10.2 |
| $C_{16}$-$C_{17}$ | 0.2 | 0.4 | 1.1 | 1.2 | 1.2 | 1.3 | 1.4 |
| $C_{18}$ | 13.7 | 11.1 | 6.8 | 4.8 | 2.9 | 3.6 | 4.0 |
| >$C_{18}$ | 4.2 | 3.3 | 1.7 | 1.3 | 1.4 | 1.5 | 1.3 |

EXAMPLE XI

Olefin metathesis was carried out under the following conditions and the product was analyzed by gas chromatography to provide the results shown in Table 5.
Catalyst: $ReO_x$/gamma-$Al_2O_3$, 1.0 gm
Oligomers: $C_{11}$+ Olefins, (1.8 CH3/12C), 50 gms
Co-catalyst: 1.4 gm $Sn(CH_3)_4$ in 100 ml hexane, 5 ml
Ethylene Pressure: 3500 Kpa at room temperature

TABLE 5

| Olefin Component | Percent time (hrs)/Temp °C. | | | | |
|---|---|---|---|---|---|
| | 0 | 0.27/28-75 | 1.75/75 | 13.0/75 | 23.3/75 |
| = or <C6 | 0 | 1.6 | 1.9 | 2.4 | 2.4 |
| $C_7$-$C_8$ | 0 | 1.7 | 3.0 | 4.1 | 4.2 |
| $C_9$ | 0.9 | 1.7 | 2.7 | 3.6 | 3.3 |
| $C_{10}$-$C_{11}$ | 1.4 | 3.1 | 4.7 | 5.6 | 5.9 |
| $C_{12}$ | 32.1 | 29.4 | 27.1 | 29.4 | 29.3 |
| $C_{13}$-$C_{14}$ | 3.0 | 3.8 | 4.6 | 4.5 | 5.2 |
| $C_{15}$ | 40.9 | 38.2 | 36.2 | 33.5 | 34.3 |
| $C_{16}$-$C_{17}$ | 1.3 | 1.7 | 2.0 | 1.9 | 1.9 |
| $C_{18}$ | 15.8 | 15.2 | 13.8 | 11.9 | 10.7 |

TABLE 5-continued

| Olefin Component | Percent time (hrs)/Temp °C. 0 | 0.27/28-75 | 1.75/75 | 13.0/75 | 23.3/75 |
|---|---|---|---|---|---|
| $>C_{18}$ | 4.2 | 3.5 | 3.4 | 2.8 | 2.8 |

EXAMPLE XII 9.0 grams of $Re_2O_7/Al_2O_3$ containing 22% $Re_2O_7$ are placed in a fixed bed reactor. The catalyst is activated in the reactor. After cooling down to room temperature, 54 cc of a solution of $Sn(CH_3)_4$ in hexane (1.4% wt/v) was pumped into the reactor and allowed to stand with the catalyst for 10 minutes. The reactor is then flushed with ethylene and pressurized with ethylene at 7000 KPa. The oligomers are pumped into the reactor passing through an online bomb containing deoxygenating agent. The reactor is maintained at room temperature and 7000 KPa ethylene pressure by cofeeding ethylene and the oligomers are pumped through the reactor (downflow) at 1.0 WHSV. The product contains 70-80% co-methhesized products as shown by GC.

Examples XIII and XIV serve to illustrate the following significant features of the co-metathesis of propylene oligomers with ethylene: disubstituted olefin reactivity in cometathesis is greater than trisubstituted olefin reactivity; use of a cocatalyst affects reactivity of di and trisubstituted olefins; reaction temperature influences the reactivity of di and trisubstituted olefins.

EXAMPLE XIII

Olefin metathesis was carried out under the following conditions and the product was analyzed by gas chromatography to provide the results shown in Table 6.

Catalyst: $ReO_x$/gamma-$Al_2O_3$, 3.0 gm

Oligomers: $C_{11}+$ Olefins, (1.3 CH3/12C), 75 gms

Co-catalyst: 1.4 gm $Sn(CH_3)_4$ in 34 ml hexane: 5 ml

Ethylene Pressure: 5600 Kpa at room temperature Temperature: Ambient

Table 6 includes the NMR analysis of the product showing the distribution of alpha olefins, disubstituted olefins, trisubstituted olefins and vinylidene olefins in the starting oligomers and the metathesized product on a mole percent basis. The Table also shows the percent of disubstituted and trisubstituted olefins in the starting oligomers which reacted in the metathesis reaction.

TABLE 6

(Example XIII)

| Olefin Component | Percent time (hrs)/Temp °C. 0 | 1.35/34-24 | 18.6/21 | 42.7/23 | 117.7/20 | 141.3/20 | 169.1/21 |
|---|---|---|---|---|---|---|---|
| = or $<C_6$ | 0 | 2.1 | 3.8 | 4.3 | 3.9 | 4.7 | 4.6 |
| $C_7$-$C_8$ | 0 | 1.9 | 7.1 | 11.3 | 13.9 | 14.5 | 14.2 |
| $C_9$ | 1.0 | 2.1 | 5.1 | 7.8 | 10.1 | 10.2 | 10.4 |
| $C_{10}$-$C_{11}$ | 0.6 | 2.8 | 7.9 | 12.5 | 16.4 | 16.1 | 16.6 |
| $C_{12}$ | 40.3 | 38.3 | 31.6 | 27.7 | 23.8 | 23.3 | 23.0 |
| $C_{13}$-$C_{14}$ | 2.2 | 2.8 | 5.1 | 7.3 | 9.5 | 9.5 | 9.0 |
| $C_{15}$ | 37.7 | 33.9 | 25.0 | 19.5 | 13.7 | 14.6 | 12.3 |
| $C_{16}$-$C_{17}$ | 0.9 | 0.6 | 1.1 | 1.5 | 2.3 | 2.1 | 2.2 |
| $C_{18}$ | 13.6 | 12.3 | 9.8 | 6.4 | 4.7 | 3.5 | 4.2 |
| $>C_{18}$ | 3.6 | 3.2 | 2.4 | 1.7 | 1.7 | 1.5 | 1.7 |
| | | | Mole % Olefin product | | | | |
| NMR data | | | | | | | |
| alpha | 0.31 | 7.4 | 23.1 | 31.6 | 45.6 | — | 44.0 |
| disubstituted | 38.5 | 33.9 | 21.9 | 14.4 | 6.6 | — | 5.7 |
| trisubstituted | 58.8 | 53.8 | 44.5 | 40.2 | 30.4 | — | 32.6 |
| vinylidene | 2.4 | 4.9 | 10.6 | 13.8 | 17.5 | — | 17.7 |
| | | | % olefin reacted | | | | |
| disubstituted | — | 4.3 | 26.9 | 41.2 | 64.1 | — | 63.3 |
| trisubstituted | — | 1.4 | 13.0 | 17.8 | 30.5 | — | 27.7 |

Final Total Increase, olefins: $<C_{12}$ + ($C_{13}$ to $C_{14}$) + ($C_{16}$ to $C_{17}$) = 52.3%;
Final Total Decrease, olefins: $C_{12}$ + $C_{15}$ + $>C_{18}$ = −54.1%

TABLE 7

(Example XIV)

| Olefin Component | Percent time (hrs)/Temp. °C. 0 | 0.25/27-75 | 1.25/75 | 7.67/75 | 17.6/75 | 47.3/75 | 71.3/75 | 115.1/75 | 138.6/75 |
|---|---|---|---|---|---|---|---|---|---|
| = or $<C_6$ | 0 | 0.6 | 0.6 | 2.1 | 3.8 | 4.2 | 5.5 | 5.4 | 5.6 |
| $C_7$-$C_8$ | 0 | 0.7 | 1.0 | 3.6 | 7.7 | 8.6 | 10.9 | 12.2 | 12.3 |
| $C_9$ | 1.0 | 1.3 | 1.4 | 3.2 | 5.7 | 6.4 | 7.4 | 8.3 | 8.4 |
| $C_{10}$-$C_{11}$ | 0.6 | 1.6 | 2.0 | 4.9 | 8.8 | 9.9 | 11.5 | 12.6 | 13.0 |
| $C_{12}$ | 40.3 | 38.6 | 36.5 | 35.0 | 30.8 | 28.6 | 24.5 | 25.2 | 24.7 |
| $C_{13}$-$C_{14}$ | 2.2 | 2.4 | 3.0 | 3.9 | 5.5 | 6.5 | 7.5 | 7.5 | 8.0 |
| $C_{15}$ | 37.8 | 36.4 | 35.6 | 30.6 | 22.3 | 23.0 | 19.0 | 17.3 | 17.3 |
| $C_{16}$-$C_{17}$ | 0.9 | 1.2 | 1.5 | 1.6 | 2.1 | 2.4 | 3.1 | 2.9 | 3.0 |
| $C_{18}$ | 13.6 | 13.4 | 13.4 | 11.5 | 9.2 | 6.9 | 7.6 | 6.1 | 5.1 |
| $>C_{18}$ | 3.6 | 3.8 | 4.9 | 3.6 | 4.1 | 3.5 | 3.0 | 2.5 | 2.6 |
| | | | | Mole % Olefin product | | | | | |
| NMR data | | | | | | | | | |
| alpha | 0.31 | — | 3.9 | 13.4 | 16.7 | — | 29.3 | — | 37.6 |
| disubstituted | 38.5 | — | 34.2 | 28.8 | 20.5 | — | 12.9 | — | 12.2 |
| trisubstituted | 58.8 | — | 57.7 | 52.8 | 57.4 | — | 52.1 | — | 44.9 |
| vinylidene | 2.4 | — | 4.2 | 5.1 | 5.4 | — | 5.7 | — | 5.3 |

TABLE 7-continued

| Olefin Component | 0 | 0.25/27-75 | 1.25/75 | 7.67/75 | 17.6/75 | 47.3/75 | 71.3/75 | 115.1/75 | 138.6/75 |
|---|---|---|---|---|---|---|---|---|---|
| | (Example XIV) Percent time (hrs)/Temp. °C. | | | | | | | | |
| | % olefin reacted | | | | | | | | |
| disubstituted | — | — | 5.5 | 16.6 | 27.1 | — | 48.1 | — | 57.7 |
| trisubstituted | — | — | 0.9 | 3.7 | 0.0 | — | 0.0 | — | 5.4 |
| Final Total Increase, olefins: $<C_{12}$ + ($C_{13}$ to $C_{14}$) + ($C_{16}$ to $C_{17}$) = 45.6%; | | | | | | | | | |
| Final Total Decrease, olefins: $C_{12}$ + $C_{15}$ + $>C_{18}$ = −45.6% | | | | | | | | | |

EXAMPLE XIV

Olefin metathesis was carried out under the following conditions and the product was analyzed by gas chromatography to provide the results shown in Table 7.

Catalyst: $ReO_x$/gamma-$Al_2O_3$, 3.0 gm

Oligomers: $C_{11}$+ Olefins, (1.3 CH3/12C), 75 gms

Ethylene Pressure: 5600 Kpa at room temperature

Temperature: 75° C.

Table 7 also includes the NMR analysis of the product showing the distribution of alpha olefins, disubstituted olefins, trisubstituted olefins and vinylidene olefins in the starting oligomers and metathesized product on a mole percent basis. The Table also shows the percent of disubstituted and trisubstituted olefins in the starting oligomers which reacted in the metathesis reaction.

The primary purpose of performing co-metathesis reactions of near-linear propylene oligomers with ethylene is to produce alpha-olefins. The alpha-olefins so produced are complex mixtures containing two types of structures. One type is linear, but contains both even and odd number carbons, and a mixture of different molecular weights. The other is near-linear with one or two methyl branches, and also contain both even and odd number carbons, and a mixture of different molecular weights. Alpha-olefins are known to be polymerizable by chromium catalysis to produce high VI lubricants.

Alpha Olefin Oligomerization

The olefins used to prepare lubes herein are from the co-metathesis reactions between propylene oligomers and ethylene. The lubes were prepared by using activated Cr (3%) on silica catalyst as described in the previously cited U.S. Patents to M. Wu. The starting olefins, experimental conditions employed, and the viscometric properties of the lubes produced according to this invention are described in Table 8 and 9.

TABLE 8

Composition of Co-metathesized Olefins Used as Lube Feed in Example XV A-D

| Olefin Components % | A | B | C | D | E | F | G |
|---|---|---|---|---|---|---|---|
| | Example XV A-G | | | | | | |
| $<C_6$ | 4.1 | 0 | 2.5 | 5.5 | 2.5 | 5.9 | 13.2 |
| $C_7$-$C_8$ | 8.6 | 4.5 | 13.0 | 16.9 | 13.0 | 12.3 | 29.8 |
| $C_9$ | 16.6 | 13.6 | 20.2 | 11.7 | 20.2 | 8.4 | 18.5 |
| $C_{10}$-$C_{12}$ | 27.1 | 33.4 | 25.9 | 39.0 | 25.9 | 37.8 | 25.6 |
| $C_{13}$-$C_{15}$ | 28.7 | 34.8 | 27.4 | 19.2 | 27.4 | 24.8 | 9.3 |
| $C_{16}$-$C_{18}$ | 12.1 | 10.9 | 8.8 | 6.3 | 8.8 | 8.1 | 2.9 |
| $>C_{18}$ | 2.9 | 2.8 | 2.2 | 1.7 | 2.2 | 2.9 | 0.7 |

Treatment of Lube Feed

| Expl. | | |
|---|---|---|
| XV A. | 1.8 $CH_3$/12C, $C_{11}^{=}$+, | $<C_9$ olefins partially removed. |
| XV B. | " | $<C_9$ olefins mostly removed. |
| XV C. | " | $<C_6$ olefins mostly removed. |
| XV D. | 1.4 $CH_3$/12C, $C_{11}^{=}$+, | nothing removed (total products). |
| XV E. | Same as XV, C | |

TABLE 8-continued

| | | |
|---|---|---|
| XV F. | 1.3 $CH_3$/12C, $C_{11}^{=}$+, | no cocatalyst, nothing removed |
| XV G. | 1.4 $CH_3$/12C, $C_8^{=}$+, | nothing removed, (total products) |

The alpha-olefin oligomers are prepared by oligomerization reactions in which a major proportion of the double bonds of the alphaolefins are not isomerized. These reactions include alpha-olefin oligomerization by supported metal oxide catalysts, such as Cr compounds on silica or other supported IUPAC Periodic Table Group VIB compounds. The catalyst most preferred is a lower valence Group VIB metal oxide on an inert support. Preferred supports include silica, alumina, titania, silica alumina, magnesia and the like. The support material binds the metal oxide catalyst. Those porous substrates having a pore opening of at least 40 angstroms are preferred.

The support material usually has high surface area and large pore volumes with average pore size of 40 to about 350 angstroms. The high surface area are beneficial for supporting large amount of highly dispersive, active chromium metal centers and to give maximum efficiency of metal usage, resulting in very high activity catalyst. The support should have large average pore openings of at least 40 angstroms, with an average pore opening of >60 to 300 angstroms preferred. This large pore opening will not impose any diffusional restriction of the reactant and product to and away from the active catalytic metal centers, thus further optimizing the catalyst productivity. Also, for this catalyst to be used in fixed bed or slurry reactor and to be recycled and regenerated many times, a silica support with good physical strength is preferred to prevent catalyst particle attrition or disintegration during handling or reaction.

The supported metal oxide catalysts are preferably prepared by impregnating metal salts in water or organic solvents onto the support. Any suitable organic solvent known to the art may be used, for example, ethanol, methanol, or acetic acid. The solid catalyst precursor is then dried and calcined at 200° to 900° C. by air or other oxygen-containing gas. Thereafter the catalyst is reduced by any of several various and well known reducing agents such as, for example, CO, $H_2$, $NH_3$, $H_2S$, $CS_2$, $CH_3SCH_3$, $CH_3SSCH_3$, metal alkyl containing compounds such as $R_3Al$, $R_3B$,$R_2Mg$, RLi, $R_2Zn$, where R is alkyl, alkoxy, aryl and the like. Preferred are CO or $H_2$ or metal alkyl containing compounds. Alternatively, the Group VIB metal may be applied to the substrate in reduced form, such as CrII compounds. The resultant catalyst is very active for oligomerizing olefins at a temperature range from below room temperature to about 250° C. at a pressure of 0.1 atmosphere to 5000 psi. Contact time of both the olefin and the catalyst can vary from one second to 24 hours. The catalyst can be used in a batch type reactor or in a fixed bed, continuous-flow reactor.

In general the support material may be added to a solution of the metal compounds, e.g., acetates or nitrates, etc., and the mixture is then mixed and dried at room temperature. The dry solid gel is purged at successively higher temperatures to about 600° for a period of about 16 to 20 hours. Thereafter the catalyst is cooled down under an inert atmosphere to a temperature of about 250° to 450° C. and a stream of pure reducing agent is contacted therewith for a period when enough CO has passed through to reduce the catalyst as indicated by a distinct color change from bright orange to pale blue. Typically, the catalyst is treated with an amount of CO equivalent to a two-fold stoichiometric excess to reduce the catalyst to a lower valence CrII state. Finally the catalyst is cooled down to room temperature and is ready for use.

The product oligomers have a very wide range of viscosities with high viscosity indices suitable for high performance lubrication use. The product oligomers also have atactic molecular structure of mostly uniform head-to-tail connections with some head-to-head type connections in the structure. These low branch ratio oligomers have high viscosity indices at least about 15 to 20 units and typically 30-40 units higher than equivalent viscosity prior art oligomers, which regularly have higher branch ratios and correspondingly lower viscosity indices. These low branch oligomers maintain better or comparable pour points.

The branch ratios defined as the ratios of $CH_3$ groups to $CH_2$ groups in the lube oil are calculated from the weight fractions of methyl groups obtained by infrared methods, published in *Analytical Chemistry*, Vol. 25, No. 10, p. 1466 (1953).

$$\text{Branch ratio} = \frac{\text{wt fraction of methyl group}}{1 - (\text{wt fraction of methyl group})}$$

EXAMPLE XV, A-G

The alpha olefin oligomerization experiments Examples XV, A-G shown in Table 9 were carried out in a flask with a slight positive nitrogen pressure to keep the reaction atmosphere inert. The catalyst comprised CO reduced, 3% chromium on silica and the total reaction time was 16 hours. Preferably, all polymerizations are carried out in a closed reactor to obtain quantitative conversions. Lube product is isolated by filtering the catalyst and distilling under vacuum to remove light components with boiling point below 400° C.

The results obtained indicate that high quality lubes can be obtained from the alpha-olefins prepared from the co-metathesis of near-linear propylene oligomers and ethylene. They also indicate that high quality lubes can be obtained from a complex mixture of alpha-olefins. The lube products have higher VI than current PAO products of similar viscosity. One hydrogenated lube also has very low pour point. The unique structures of the starting alpha-olefins containing both linear and near-linear structures, with even and odd number carbons, and a broad distribution of molecular weights, are held to be most suitable for the production of high VI and low pour point lube product. The product can be hydrogenated by means well known in the art to eliminate olefin unsaturation and provide a stable, commercially useful lubricant.

TABLE 9

Olefin Oligomerization to Lubes

| Feed | Feed/Cat. Wt ratio | Polymerization Temp., °C. | Kv, Cs 40° C. | Kv, Cs 100° C. | Lube VI | pour pt. |
|---|---|---|---|---|---|---|
| XVA | 10/1 | 125 | 466.15 | 46.96 | 158 | −49° C. |
| XVA' | 15/1 | 102 | 126.19 | 19.49 | 176 | |
| XVB | 25/1 | 110 | 262.3 | 33.6 | 173 | |
| XVC | 25/1 | 110 | 269.79 | 33.1 | 167 | |
| XVD | 20/1 | 110 | 529.5 | 53.27 | 164 | |
| XVE | 25/1 | 110 | 487.5 | 52.3 | 171 | |
| XVF | 25/1 | 110 | 459.3 | 49.5 | 169 | |
| XVG | 25/1 | 110 | 438.5 | 41.5 | 145 | |

Figure 2:
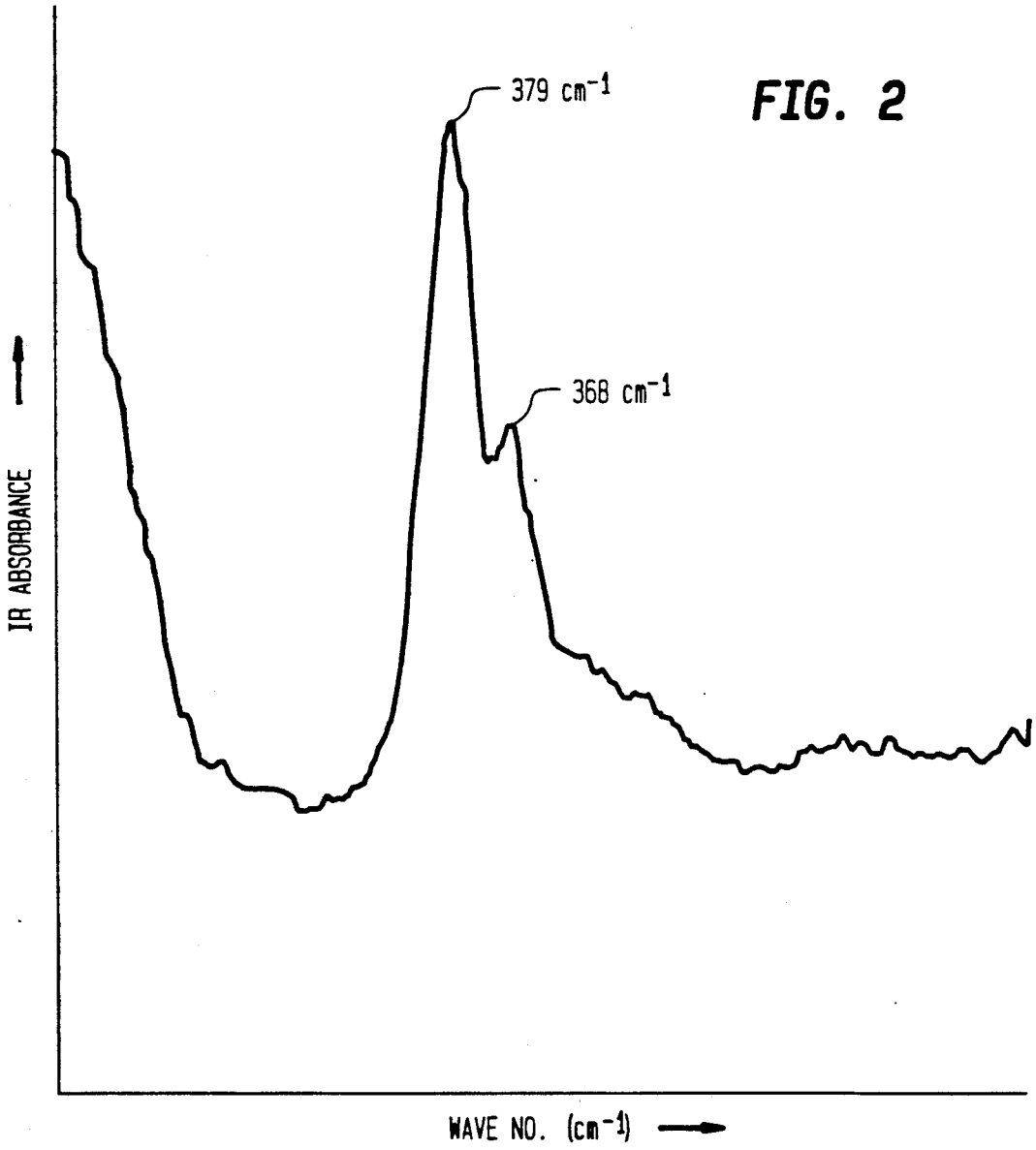
FIG. 2 is an infrared (IR) spectrocopic plot of a lubricant composition according to the present invention.

From the above examples, XV-B, -C, -E and -F are preferred embodiments of the novel compositions and were analyzed by standard infrared (IR) spectroscopy methods to determine their branching by measurement of methyl group content. As shown in FIG. 2 of the drawing, the lubricant composition of Example XV-C has absorbance peaks at 379 $cm^{-1}$ and 368 $cm^{-1}$, which peaks correspond to the presence of terminal methyl groups and internal methyl groups, respectively. By the standard IR method this example is shown to have a total methyl group weight fraction of 0.283 of which 46% are internal methyl groups attached to a tertiary carbon atom in an oligomer chain. Table 10 compares the methyl fraction (Me) of a number of lubricant compositions.

TABLE 10

| Composition | Terminal Me | Internal Me | VI | Comments |
|---|---|---|---|---|
| Example XV-B | 0.148 | 0.062 (30%) | 173 | |
| Example XV-C | 0.153 | 0.130 (46%) | 167 | |
| Example XV-E | 0.254 | 0.154 (38%) | 171 | |
| Example XV-F | 0.219 | 0.135 (38%) | 167 | |
| Std PAO stock 979 cat. | 0.102 | — (0%) | 188 | decene/BF3 |
| HVI-PAO (hydrgntd) | 0.162 | — (0%) | | decene/Cr |
| HVI-PAO (unhydrgntd) | 0.184 | (0%) | | decene/Cr |

It is noted that the decene-based PAO and HVI-PAO materials do not have the distinctive internal Me peak at 368$^{cm-1}$. In the novel hydrocarbon lubricants according to this invention, the total methyl weight fraction is greater than 0.2; whereas the comparable poly(alpha-decene) materials are substantially less branched and have a lower methyl content.

The novel compositions prepared according to the present invention preferably contain about 25-50% of the methyl groups internal. The properties of such lubricant materials do not follow the general rule that higher degree of branching produces lower viscosity index. This appears to be due to the structure of the sub-branching on the side chains of the oligomer achieved in these materials. Thus, the economic use of C3 propene-based feedstock is permitted, while maintaining product quality.

The lubricants produced from the near linear olefins prepared according to the process of this invention show remarkably high viscosity indices (VI) with low pour points at viscosities from 2 cS (100° C.) and higher. They can be prepared in a wide range of viscosities typical of those achievable in the reduced chromium catalyzed reaction described in the cited patents of M. Wu. However, where the products described by M. Wu exhibit high VI by preparing oligomers having a branch index below 0.19, the branch indices of the lubricants prepared according to this invention are above 0.20.

The near linear alpha olefins oligomerized in this invention to provide high VI lubricant are characterized as having branching confined predominantly to the pendant alkyl group of the oligomer lubricant molecule. While it is known and taught in the cited Wu patents that branching in the backbone of the lubricant molecule adversely effects VI, it has been surprisingly discovered herein that lubricants with high VI can be prepared from slightly branched alpha olefins by reduced chromium catalysis if those branches are restricted predominantly to the pendant alkyl group of the oligomer molecule. While not wishing to be limited by theoretical considerations, it is believed that the CO reduced chromium oxide on silica catalyst described by Wu oligomerizes near linear alpha olefins with little isomerization and consequent branching occurring in the oligomer backbone. It is held that low backbone branching dominates the factors and intermolecular associations that provide high VI as an end result in the product, with branching in the pendant alkyl portions of the oligomer molecule found to have little effect on the degradation of VI.

While the composition has been described by specific examples and embodiments, there is no intent to limit the inventive concept except as set forth in the following claims.

We claim:

1. A hydrocarbon lubricant fluid composition having viscosity index made by the steps comprising: contacting a mixture comprising slightly branched and linear $C_9$–$C_{18}$ alpha olefins under oligomerization conditions with CO reduced chromium catalyst on silica support; wherein said alpha olefins comprise the olefin metathesis reaction product of slightly branched higher olefinic hydrocarbons wherein said olefinic hydrocarbons comprise $C_{11}+$ hydrocarbons having about 1–2 methyl branches per 12 carbon atoms with the $C_2$–$C_4$ 1-alkenes in contact with metathesis catalyst, and said higher olefinic hydrocarbons comprise the oligomerization product of lower alkene oligomerized in contact with surface deactivated, acidic, medium pore, shape selective metallosilicate catalyst under oligomerization conditions; and separating the higher alpha olefins oligomerization reaction product to provide said lubricant having a branch index above 0.20, a viscosity index greater than 130 and a pour point less than −15° C.

2. The composition of claim 1 wherein said lubricant composition is hydrogenated.

* * * * *